United States Patent [19]

Torongo

[11] 4,058,220

[45] Nov. 15, 1977

[54] DISPLAY DEVICE WITH OVERLAPPING CARDS

[75] Inventor: Albert Henry Torongo, Yardley, Pa.

[73] Assignee: Borden, Inc., Columbus, Ohio

[21] Appl. No.: 685,642

[22] Filed: May 12, 1976

[51] Int. Cl.[2] ..... A47F 1/00

[52] U.S. Cl. ..... 211/57.1; 206/461; 206/806

[58] Field of Search ..... 206/461–463, 206/465–471, 498, 497, 493, 806; 248/223, 224, 225, DIG. 3; 211/49–59, 105.1, 123; D9/191, 192

[56] References Cited

U.S. PATENT DOCUMENTS

| | | | |
|---|---|---|---|
| 1,163,615 | 12/1915 | Cooley | 206/806 X |
| 2,931,494 | 4/1960 | Pfohl | 206/462 |
| 3,025,968 | 3/1962 | Snape | 211/59 |
| 3,246,814 | 4/1966 | Lovell et al. | 206/461 X |
| 3,251,464 | 5/1966 | Hanson | 211/57 X |
| 3,307,693 | 3/1967 | Bittner | 206/461 |
| 3,442,396 | 5/1969 | Cass | 211/59 |
| 3,770,120 | 11/1973 | Hanson | 206/461 X |

*Primary Examiner*—Roy D. Frazier
*Assistant Examiner*—Terrell P. Lewis
*Attorney, Agent, or Firm*—Daniel D. Mast; George P. Maskas; George A. Kap

[57] ABSTRACT

Display cards for thick packages such as tubes of cement are provided with an off-center hole for hanging on a pin and with a clipped upper corner that allows overlapping of the cards, close spacing, and simultaneous display of adjacent tubes of product.

3 Claims, 2 Drawing Figures

DISPLAY DEVICE WITH OVERLAPPING CARDS

BACKGROUND OF THE INVENTION

The present invention relates to an improved display of articles for sale to customers in self-service stores. More specifically, it relates to a novel package for use in a carded-merchandise display where the cards are hung on hooks extending out from a supporting surface such as a peg board. There is a great convenience to shoppers in self service retail stores where the merchandise and the information relating to the merchandise, such as the description of the product and how it is to be used are readily visible to the purchaser. Many packages have been provided which contain the articles to be offered for sale and also have imprinted on the packages some information helpful to the purchaser. Through the use of such displays, information needed by the purchaser is readily available even before the sale so that the customer can determine whether the product is the particular one that he desires to purchase. By making this information available to the customer on a display, it then becomes unnecessary, in most instances, for the clerk of the store to answer the many questions that the prospective purchaser might have with respect to the proper product and how it is to be used. For instance, there are many types of adhesives and cements produced for various jobs. The right cement for the right job can be selected by the customer with a minimum of questions directed to a clerk of the store. Such a display also makes the information more available to the store owner and clerks so that they can be more effective in merchandising the product and in making sure that the purchaser gets the right product for its intended use. Obviously then, the clerks and store owner are free to carry out other duties such as restocking the display and the various other daily chores which would be very difficult to carry out where it was necessary to answer questions all day of prospective purchasers. The diversity of merchandise in many stores is such that a retail clerk cannot be well informed about all of them and the carded information is often more reliable than that available from the store employees.

The storage of a larger number of articles on a display board is advantageous both to the store owner and to the consumer. Where the article to be displayed is quite thick and bulky, there is a limit to the number of the carded articles which can be mounted on the display area. Where a hook 6–8 inches in length is used and the product is about 1 inches thick, it is possible to straight stack only about 8 cards on each hook.

In order to display more merchandise in a given display area, it is advantageous to overlap and/or stack the merchandise on the display board. Straight stacking has the disadvantage that the amount of product that can be displayed is the function of the thickness or depth of the product. Overlapping in the past has been accomplished vertically. This usually entails placing a second hole in each card in an ppropriate position along the verticle center line of the card or by stacking two cards of different length on the same peg. In the first method each card must be placed on two pegs which makes it more difficult to place the card on and to remove the card from the pegs. The second hole must be placed in a prime graphics area which is disadvantageous. The use of cards of two sizes has the obvious disadvantage of requiring inventory of two different cards. Horizontal overlap of cards has required the use of two pegs and two holes in each card in the past. Although two horizontal holes and two pegs seems an improvement over two vertically disposed holes there is still a remaining problem with respect to removal of the cards from the display board.

SUMMARY OF THE INVENTION

It is an object of the present invention to provide a package which permits higher density packing and display of articles on a display board.

It is another object to provide a low cost package for articles of merchandise, which facilitates identification by purchasers of the nature and usefulness of the article displayed.

The present invention provides a card having the largest possible continuous graphics area on both sides of the card, the product positioned to a farside from the vertical center of the card, an off-center hole positioned in such a manner that the card and product hangs straight vertically, and a clipped corner that allows close spacing of adjacent pegs and thereby close spacing of overlapping cards in a horizontal line.

BRIEF DESCRIPTION OF THE DRAWING

The invention will be better understood by a reference to the drawings wherein.

DESCRIPTION OF THE PREFERRED EMBODIMENT

Figure 1:
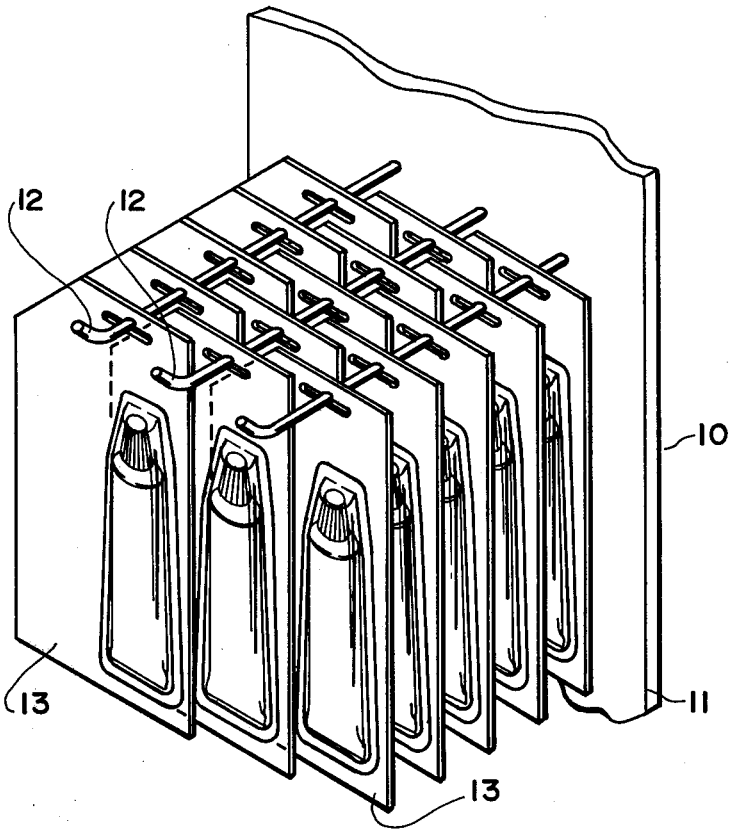
FIG. 1 is a perspective view of a display board with a plurality of horizontally overlapped card packages.

The display device 10 includes a peg board 11, a plurality of pegs 12, 12, and overlapping display packages 13, 13 disposed on the pegs. When the pegs are on two-inch centers, the cards of the display package will be about four inches wide as shown in FIG. 1.

Figure 2:
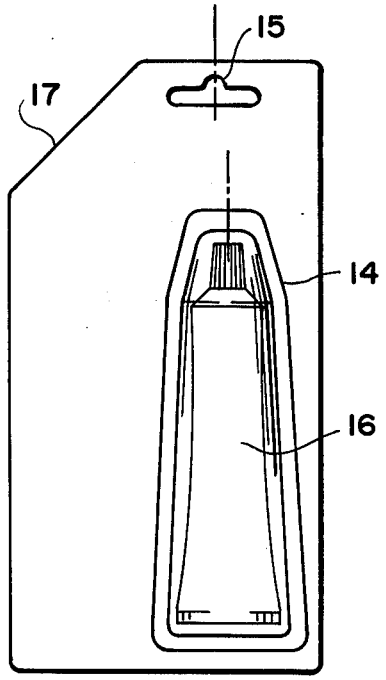
FIG. 2 is an elevational view of single card package.

The display package 13 includes a card 14 having a hanging hole 15 that is off-center as shown in FIG. 2. The hole 15 can be provided with a slot, as shown, to make it easier to hang and remove the card on and from the peg. The illustrated merchandise is a tube of cement or adhesive mounted on the right side of the card in FIG. 2. The tube 16 is adhered to the card 14 by blister packing or in some other manner secured thereto. Card 14 is provided with a tapered corner 17 so that adjacent pegs 12, 12 can be closely spaced without interferring with cards suspended on adjacent pegs, see FIG. 1. The center line of the tube of cement is shown to the right of the center line of the hanging hole 15. This spacing is provided so that the card with the merchandise thereon hangs straight vertically on a single peg and single hanging hole. Such an arrangement also provides an extensive, unbroken graphics area on each card.

The card can be of a conventional card stock such as a sulfite board and should have two surfaces that are printable. As can be seen by an inspection of FIG. 2, the tube of cement is placed well to the right side of the card so that when the cards are hung on adjacent pegs they overlap as shown in FIG. 1 without cover-up of the product. Each tube in a layer of cards is exposed to the prospective purchaser.

In order to gain the maximum amount of horizontal overlap the product has been affixed to the card as far off vertical center as possible. This placement is inherent in the configuration of the card as shown in the drawings. Moving the product to the far side moves the hanging hole to one side, well off the vertical center line of the card and allows maximum overlap without causing the product to overlap product. The tapered corner can be replaced by a suitable slot which allows close spacing of the pegs and the cards.

Obvious variations and modifications can be made without departing from the spirit of scope of the invention as claimed.

I claim:

1. A display device and a plurality of overlapping display packages thereon comprising;

a. a board having a plurality of pegs arranged side by side in a row, said pegs being suitable for supporting display packages;

b. a plurality of display packages each of which includes an article of merchandise secured to a card, each of said cards being of a uniform width and having an off-center hole near one upper corner for accepting one of said pegs and a clipped corner at the opposite upper corner of the card, said article of merchandise being positioned off-center at that side wherein said off-center hole is located, said display packages being suspended on said pegs in multiple layers of overlapping cards, the distance between holes of adjacent suspended cards being less than the overall width of a single card, and each card being suspended from a single peg through its off-center hole with the clipped corner of the card being immediately adjacent the adjoining peg, whereby at least one of said articles remaining on any one of said pegs is entirely exposed to view.

2. The display device of claim 1 wherein the distance between adjacent pegs is not more than one-half the width of a single card.

3. The display device of claim 1 wherein the cards are generally vertical and the height of the card is greater than the width and the articles of merchandise are secured to the card at one side of the card and generally vertically.

* * * * *